US008558437B2

(12) United States Patent
Pabst et al.

(10) Patent No.: US 8,558,437 B2
(45) Date of Patent: Oct. 15, 2013

(54) LAMP

(75) Inventors: Wolfgang Pabst, Deisenhofen (DE); Robert Kraus, Regensburg (DE); Thomas Noll, Kipfenberg (DE); Ulrich Henger, Eichenau (DE)

(73) Assignee: Osram Gesellschaft mit beschrankter Haftung, Munich (DE)

( * ) Notice: Subject to any disclaimer, the term of this patent is extended or adjusted under 35 U.S.C. 154(b) by 435 days.

(21) Appl. No.: 12/677,330

(22) PCT Filed: Sep. 10, 2008

(86) PCT No.: PCT/EP2008/007392

§ 371 (c)(1),
(2), (4) Date: Mar. 10, 2010

(87) PCT Pub. No.: WO2009/033641

PCT Pub. Date: Mar. 19, 2009

(65) Prior Publication Data

US 2010/0207500 A1 Aug. 19, 2010

(30) Foreign Application Priority Data

Sep. 10, 2007 (DE) ..... 10 2007 042 978

(51) Int. Cl.
*H01J 1/02* (2006.01)

(52) U.S. Cl.
USPC ..... 313/46; 362/294

(58) Field of Classification Search
USPC ..... 313/46, 45
See application file for complete search history.

(56) References Cited

U.S. PATENT DOCUMENTS

| | | | | |
|---|---|---|---|---|
| 4,350,931 | A * | 9/1982 | Niskin | 315/72 |
| 4,661,746 | A | 4/1987 | Postma et al. | |
| 5,214,354 | A | 5/1993 | Johnson | |
| 5,458,505 | A * | 10/1995 | Prager | 439/485 |
| 2001/0000941 | A1 | 5/2001 | Chandler et al. | |
| 2003/0040200 | A1 | 2/2003 | Cao | |
| 2004/0120148 | A1 | 6/2004 | Morris et al. | |
| 2007/0091610 | A1 | 4/2007 | Dorogi | |
| 2009/0180288 | A1 | 7/2009 | Mehlmann et al. | |

FOREIGN PATENT DOCUMENTS

| | | | |
|---|---|---|---|
| DE | 3111803 | A1 | 10/1982 |
| DE | 3519175 | A1 | 12/1985 |
| DE | 10316512 | A1 | 10/2004 |
| DE | 102005053469 | A1 | 2/2007 |
| EP | 1047903 | B1 | 6/2007 |

OTHER PUBLICATIONS

English translation of International Preliminary Report on Patentability issued for PCT/EP2008/007392 on Apr. 7, 2010.
International Search Report of PCT/EP2008/007392 mailed Feb. 13, 2009.
DE 3111803 A1—English-language Abstract.
DE 10316512 A1 English-language Abstract.

* cited by examiner

*Primary Examiner* — Mary Ellen Bowman

(57) ABSTRACT

A lamp may include at least one housing; a heat source connected thereto; and a base for connection to a lampholder, wherein the base has at least one heat dissipation surface, and wherein at least one heat source is thermally conductively connected to at least one heat dissipation surface.

19 Claims, 7 Drawing Sheets

LAMP

RELATED APPLICATIONS

The present application is a national stage entry according to 35 U.S.C. §371 of PCT application No. PCT/EP20081007392 filed on Sep. 10, 2008, which claims priority from German application No. 10 2007 042 978.0 filed on Sep. 10, 2007.

TECHNICAL FIELD

Various embodiments relate to a lamp, a luminaire and a system including a lamp and a luminaire.

BACKGROUND

In order to dissipate heat generated in a lamp, various methods are described such as thermoelectric cooling or air cooling with a fan, for example as in US 2003/040200 A. However, the previously known methods are either not very efficient or are comparatively complex or bulky.

SUMMARY

Various embodiments provide an option which has improved thermal properties of light-emitting means, e.g. lamps and luminaires, and at the same time can be implemented comparatively easily and is space-saving.

The lamp has a housing and at least one heat source connected directly or indirectly thereto. The lamp also has a base for connection to or for engagement with a lampholder, wherein the base has at least one heat dissipation surface, and at least one heat source is thermally conductively connected to at least one heat dissipation surface.

Thermally conductive is in particular understood to mean a connection which has a thermal conductivity coefficient of at least 5 W/(m·K), especially of greater than approximately 15 W/(m·K), as is typical for Cr—Ni steel. Also included are the thermal conductivities of thermally conductive pastes, films and adhesives. The thermal conductivity makes it possible to dissipate a significant quantity of heat from the heat source.

This provides the possibility of a lamp in which the heat generated in the lamp can be transmitted efficiently via a "base/lampholder connection" to the luminaire or illumination device, to which the lamp is connected during operation. This device manages without any voluminous or complex active elements.

The heat source is generally a heat-emitting element and can in particular include a light source and/or a driver circuit.

The light source can in particular comprise at least one light-emitting diode and/or a discharge lamp. In the case of a discharge lamp, a compact fluorescent lamp, in particular an electrodeless compact fluorescent lamp (RCFL) or a high intensity discharge lamp (HID) is preferred. Light-emitting diode can in this case be understood to mean individual light-emitting diodes, for example monochromatic or white LEDs, but also groups or clusters of LEDs which together emit an additive color mixture. Examples of LED clusters are clusters including the primary colors R, G and B, in particular of the type RGGB. Also included are chains including interconnected LEDs.

Preferably, the base is a bayonet-type base, wherein said base protrudes at one end (toward the (lower) side facing the lampholder) and electrical contacts are formed laterally on said base. The electrical contacts are typically electrically insulated from the rest of the base. The base outside of the electrical contacts can serve completely as a heat dissipation surface. However, it may also be preferable for only an underside (which is opposite the lampholder) or only side faces of the base to serve as a heat dissipation surface. In addition, the heat dissipation surface can include one or more locally limited zones.

For reliable electrical contact-making, it is preferable if the electrical contacts are bow contacts which are located on webs extending laterally from the base; in particular if the contacts are arranged at the end.

The electrical contacts are preferably arranged radially symmetrically about the base. Two or four electrical contacts are preferred, but the arrangement is not restricted thereto.

Alternatively, however, the base can also be in the form of a screw-type base, for example with a heat dissipation surface which points downwards in the center.

Alternatively, a lamp may be preferred in which the base includes at least one locking piece or opposing locking piece for a ball lock.

Also preferred is a base which has at least one laterally arranged electrical contact.

Alternatively or in addition, the base can have at least one electrical contact which is arranged at the end, in particular centrally.

Then, particularly preferred is a lamp in which the at least one electrical contact arranged on the underside at the same time represents a heat dissipation surface.

Alternatively, the base may be a base in accordance with the so-called Gardena principle or design.

Generally preferred is a lamp in which a heat-conducting element is provided for the thermally conductive connection between the at least one heat source and the at least one heat dissipation surface. The heat-conducting element includes a material with high thermal conductivity, in particular a material having a thermal conductivity coefficient of at least approximately 5 W/(m·K), in particular more than approximately 15 W/(m·K), as is typical for Cr—Ni steel, and more preferably of more than approximately 50 W/(m·K) and especially preferably of more than 300 W/(m·K), for example including copper.

Then, a heat-conducting element which includes a metal line is preferred.

However, a heat-conducting element which has a heat pipe can also be preferred for particularly effective heat dissipation.

Alternatively or in addition, the heat-conducting element includes the lampholder which can have metallic inner faces, for example.

In general, it may be preferable if at least one heat dissipation surface is at the same time an electrical contact.

For effective heat dissipation, however, a lamp may also be preferable in which at least one heat source is applied to a circuit board, and the circuit board is fitted directly on the base or on a heat-dissipating housing. As a result, the heat transport path is shortened and the heat dissipation is intensified. The circuit board then preferably has a metal core or a metal surface on the rear side for uniform heat distribution.

For direct and particularly effective heat dissipation, however, a lamp can also be preferred in which at least one heat source, for example an LED, a fluorescent tube or driver electronics, is fitted directly on the heat-conducting housing or on the base, for example by means of a thermally conductive adhesive.

In addition, a lamp is preferred in which the height of the base is no more than 15 mm, preferably less than 9 mm, further preferably less than 5 mm.

For effective heat transfer between the lamp and lampholder, at least one heat dissipation surface is preferably covered at least partially by a thermally conductive film.

Also preferred is a lamp as claimed in one of the preceding claims, which additionally has a cylindrical extension on the base, in which extension an electronic and/or electrical circuit, or a part thereof, is accommodated.

Various embodiments also provide a lampholder for accommodating a lamp as described above and a luminaire with such a lampholder.

Preferred is a luminaire with heat dissipation surfaces, which are in thermal contact with the heat dissipation surfaces of the lamp when the lamp is inserted.

Preferably, the heat dissipation surfaces are thermally conductively connected to a cooling element, for example a cooling plate or cooling ribs of the luminaire.

Various embodiments also provide a system with a lamp as described above and a luminaire as described above.

Preferably, a thermal bonding means is provided between the lamp and the lampholder, for example by means of a thermally conductive paste or in the form of a thermally conductive film. The film is preferably easily deformable with a high degree of elasticity in order to enlarge the contact surface or is plastically deformable. The thermal bonding means can be formed as part of the base or as a separate component part.

For a firm fit, a system is preferred in which the base of the lamp and the lampholder have a deviation in form, at least in sections.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
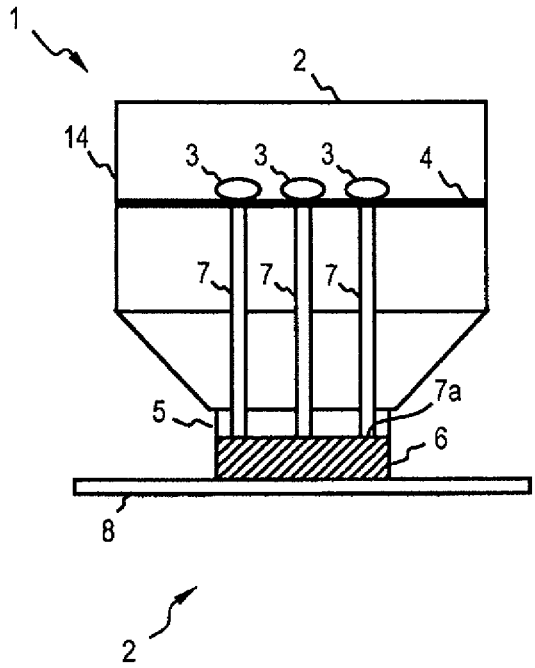
FIG. 1 shows, as a cross section, a side view of a sketch of a luminaire with a lamp in accordance with a first embodiment.

FIG. 1 shows a lamp, which is accommodated in a luminaire 2. The lamp 1 has a partially transparent housing 14 which includes a plurality of light-emitting diodes 3 which are fitted on a circuit board 4 (also referred to as a light-emitting module). A base 5 of the lamp 1 is inserted into a lampholder 6 of the luminaire 2 and thus electrically and mechanically connected thereto.

In order to dissipate the waste heat generated by the light-emitting diodes 3 during operation, each of the light-emitting diodes 3 is connected to a heat-conducting element 7, via which the waste heat is dissipated through the base 5 into the lampholder. For this purpose, the base 5 has a plurality of heat dissipation surfaces 7*a*, which correspond to the outer surfaces or undersides of the heat-conducting elements 7, possibly with an additional layer, for example consisting of thermally conductive paste or film. The heat dissipation surfaces 7*a* are in good thermal contact with a corresponding thermally conductive zone or a plurality of zones of the lampholder. The heat is conducted further to a cooling zone 8 in or by the lampholder 6.

In the exemplary embodiment shown, the heat-conducting element 7 in each case includes a heat pipe; the lampholder can have corresponding heat pipes (not depicted), which conduct the heat towards the cooling zone 8.

In addition, electrical or electronic control components, which emit heat, can also be connected to the lampholder via heat-conducting elements 7.

Alternatively, the heat-conducting elements are not in the form of heat pipes, but comprise a material with good thermal conductivity, such as copper, silver or gold.

Alternatively, a common heat dissipation surface for a few or all of the heat-conducting elements 7 can be provided.

Figure 2:
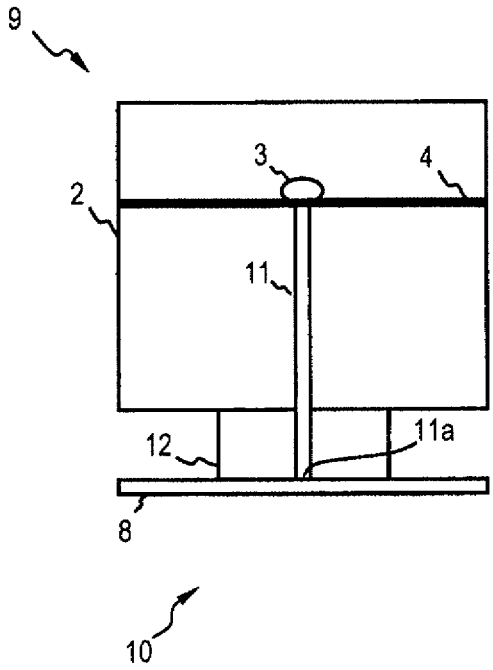
FIG. 2 shows, as a cross section, a side view of a sketch of a luminaire with a lamp in accordance with a further embodiment.

FIG. 2 shows an alternative embodiment of a system comprising a lamp 9 and a luminaire 10, in which the lamp 9 now has an individual light-emitting diode 3, which is mounted on the circuit board 4 and whose heat is conducted via a copper bolt 11 towards the cooling face 8 of the luminaire 10. The copper bolt 11 is connected to the cooling face 8, for example a cooling plate, by means of a spring contact; its underside corresponds to the heat dissipation surface 11*a*.

In this case, the base includes a cylindrical extension ("rucksack"), in which an electronic and/or electrical circuit, or a part thereof, is accommodated. Preferably, ballast electronics, in particular a smoothing capacitor, are accommodated at least partially in the rucksack; this being the case even when using a fluorescent lamp instead of the LED 3. The lampholder, which is not illustrated here for reasons of improved clarity, in this case has a corresponding recess. The rucksack 12 is designed to be thermally conductive so as to store heat. The rucksack 12 also has electrical or electromechanical contact-making and a thermally conductive connection to the luminaire or the lampholder 10 thereof.

Figure 3:
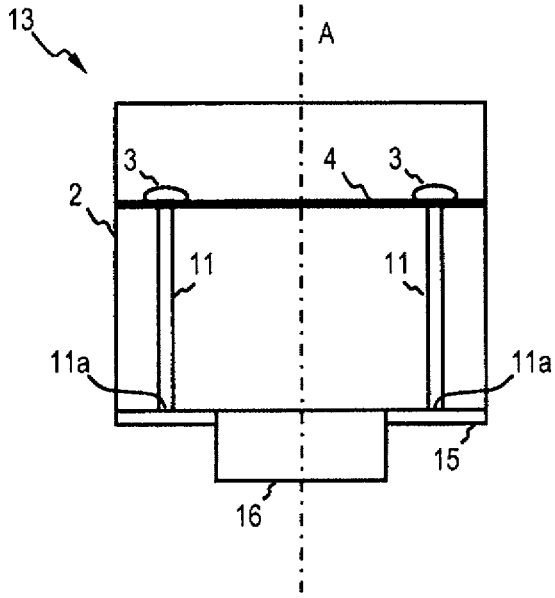
FIG. 3 shows, as a cross section, a side view of a sketch of a luminaire with a lamp in accordance with a further embodiment.

FIG. 3 shows an embodiment, similar to that in FIG. 2, of a lamp 13, in which, however, a plurality of light-emitting diodes 3 are arranged symmetrically about a longitudinal axis A ("LED ring") and are connected directly and in a thermally conductive manner to the cooling zone 15 of the luminaire. As a result of the direct arrangement of the cooling zone 15 on the underside of the housing 2, a particularly large cooling surface and a short distance from the heat sources 3 are produced. The rucksack 16 also in this case has electrical or electromechanical contact with the lampholder 14 of the luminaire and can accommodate parts of the driver electronics or an electrical unit. The heat-conducting elements are present in the form of prestressed copper bolts 11.

Figure 4:
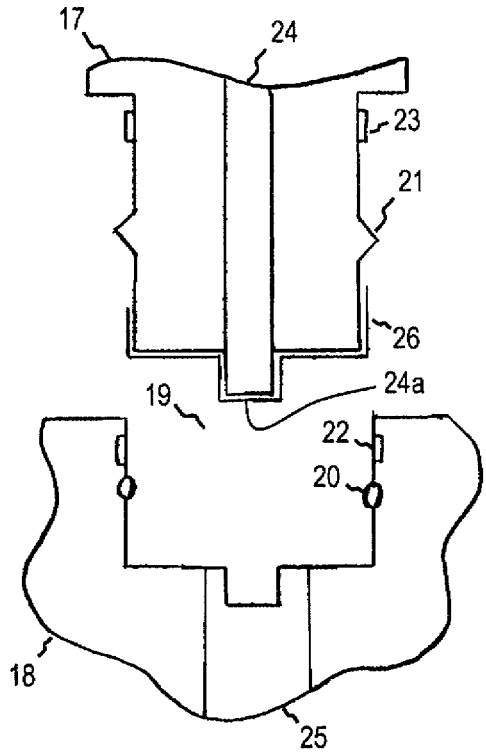
FIG. 4 shows, as a cross section, a side view of a sketch of a luminaire with a lamp in accordance with yet a further embodiment.

FIG. 4 shows a base 17 or the rucksack in the form of a base part of a lamp with the matching lampholder 18 of a luminaire, which has a receptacle 19 for receiving the base 17 or the lamp. Locking balls 20, which, when the base 17 is inserted, hold locking pieces 21 provided thereon in the form of projections in the lampholder 18 and press said locking pieces into said lampholder, are provided in the receptacle 19. When the base 17 is fitted in, in addition electrical contacts 22 of the lampholder 18 and electrical contacts 23 of the base 17 are in electrical contact and thus supply current to the lamp.

For thermal dissipation, a heat conductor 24 of the lamp extends into a cutout in a relatively wide heat conductor 25 of the lampholder 18. The associated contact surface corresponds to the heat dissipation surface 24*a*. For improved heat transfer between the base 17 and the lampholder 18, a film 26 consisting of thermally conductive metal is provided between the heat conductors 24, 25. The heat conductors 24, 25 are each in the form of heat pipes. The heat conductors 24, 25 can be in the form of electrical conductors.

In one variant, the lampholder is designed in such a way that a voltage at a first voltage level, for example 230 V, is provided via the lateral contacts 22, and a voltage at a second voltage level, for example 24V, is provided at the lower or end-side contact, which in this case is formed by the heat conductor 25. As a result, the lampholder 18 can be suitable, without being changed, for lamps with a voltage supply at the first voltage level with lateral contacts 23 and, alternatively, for lamps with a voltage supply at the second voltage level with lower contacts 24.

Figure 5:
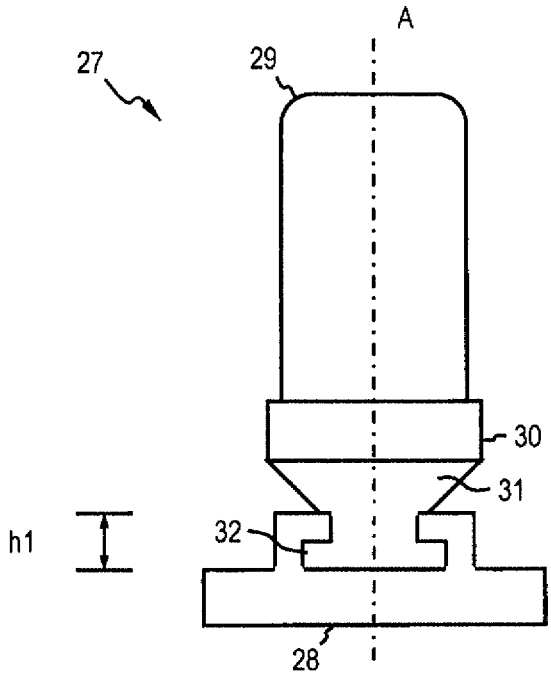
FIG. 5 shows, as a cross section, a side view of a sketch of a luminaire with a lamp in accordance with yet a further embodiment.

FIG. 5 shows a further, novel lamp 27 which is fitted into a lampholder 28 of a luminaire. A transparent bulb 29 is supported by the lamp housing 30. The base 31 of the lamp 27 interacts with the lampholder 28 of the luminaire.

The base 31 is in the form of a bayonet-type base which has a height h1 in that region which engages or interacts with the lampholder 28 and is equipped with base webs 32, which are lateral with respect to a longitudinal axis A.

By means of rotating the lamp 27 in or into the lampholder 28, the lamp 27 is pressed firmly against the lampholder 28. In order to increase the pressure, the base 31 and the lampholder 28 can have at least sections which deviate from their basic shape, which is in this case cylindrical, at the contact region, for example be designed to be slightly conical or elliptical. The height h1 in this case is less than 5 mm.

Figure 6:
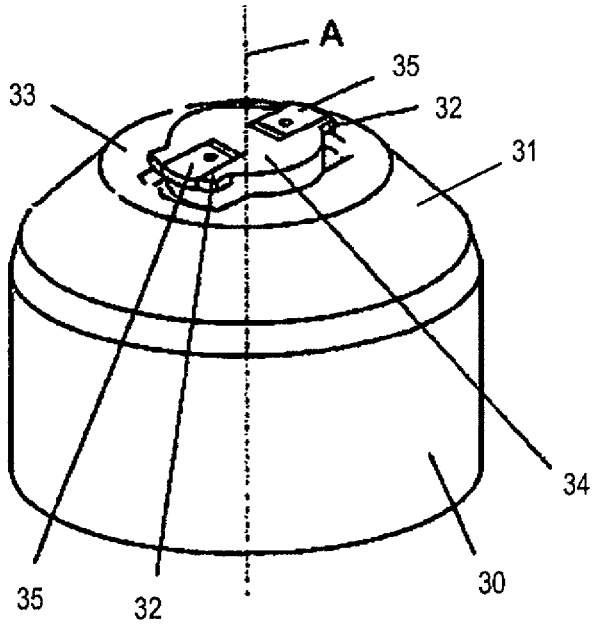
FIG. 6 shows a view from below at an angle of a lamp housing for a lamp with a novel bayonet-type closure.

FIG. 6 shows the housing 30 and the base 31 shown in FIG. 5 from below at an angle with a relatively high degree of accuracy. A bayonet-type closure element 34, which protrudes by the height h1 from the underside 33 of the actual base 31, has the webs 32 laterally on its underside. The webs 32 have in each case at the end a bow contact 35 for making electrical contact with the lamp. The bayonet-type closure element 34 can also be viewed as a rucksack with the height h1. The bow contacts 35 are electrically insulated from the rest of the base 31. In this case, the underside 33 of the base 31 represents the essential heat dissipation surface of the lamp.

Figure 7:
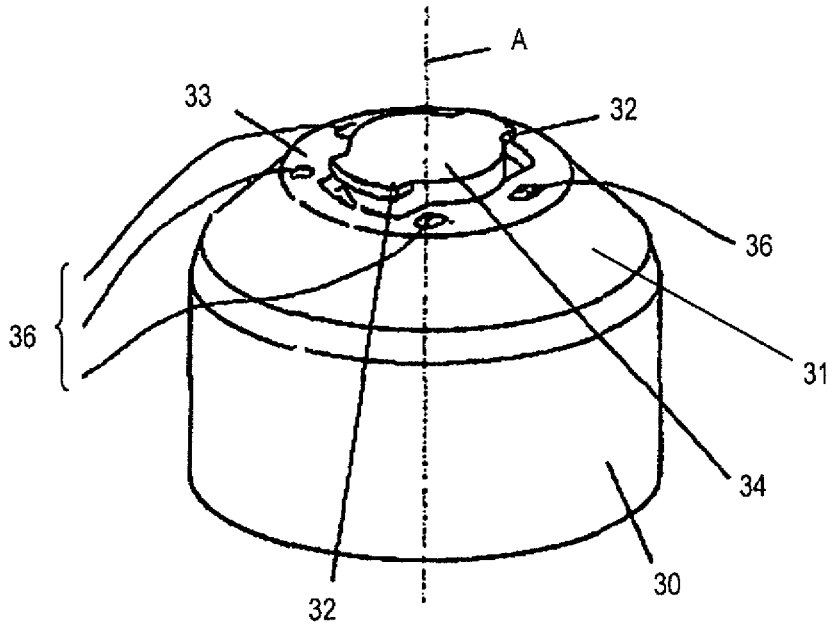
FIG. 7 shows a view from below at an angle of a lamp housing for a lamp with a novel bayonet-type closure in accordance with a further embodiment.

FIG. 7 shows a further novel lamp with a bayonet-type closure. In contrast to the embodiment shown in FIG. 6, the contacts 36 are now no longer arranged on the webs 32 of the bayonet-type closure element 34, but on the end-side underside 33 of the base 31. By correspondingly configuring the lampholder (not depicted), these lamp contacts 36 can be brought to coincide in contact-making fashion with corresponding contacts on the lampholder when the lamp is completely locked in the lampholder. In this case, the underside 33 of the base 31 likewise represents the main heat dissipation surface of the lamp.

The invention is of course not restricted to the embodiments shown or the described elements thereof.

Thus, compact fluorescent lamps and/or light-emitting diodes, for example, can be used as light sources; but other suitable light sources can also be used.

The driver circuit is not restricted to a particular embodiment and can contain any desired suitable electrical and/or electronic elements. Particularly preferred is, for example, an arrangement of LEDs connected back-to-back in parallel. Also, the driver circuit can include a simple rectifier, for example, in which the light-emitting diode, the light-emitting diode cluster or LED chain are preferably arranged in a branch of the rectifier. Also, the driver preferably includes a current limiter, for example, a resistor or a current regulator. The driver can also include a switched mode power supply, preferably a so-called flyback converter.

The circuit board can have a substrate including PCB, FR4 or MC-PCB, for example.

The base preferably has a very short physical height for insertion into a corresponding lampholder. Said lampholder can preferably have a height of up to 15 mm, particularly when measured without the rucksack. For the case in which a rucksack is used, an increased height can also be advantageous since the rucksack, as part of the base, is sunk into the cutout provided in the lampholder.

The number and/or arrangement of the contacts both of the lamp and of the lampholder can be assigned to coding information, for example with respect to the lamp type or a voltage class.

In particular, the heat pipes, but also other metallic heat dissipation elements can generally also be in the form of electrical contacts. The heat dissipation elements can also include nonmetallic conductive elements, for example, electrically conductive ceramics.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE SYMBOLS

1 Lamp
2 Luminaire
3 Light-emitting diode
4 Circuit board
5 Base
6 Lampholder
7 Heat pipe
7*a* Heat dissipation surface
8 Cooling element
9 Lamp
10 Luminaire
11 Copper bolt
11*a* Heat dissipation surface
12 Rucksack
13 Lamp
14 Housing
15 Cooling zone
16 Rucksack
17 Base
18 Lampholder
19 Cutout
20 Locking balls
21 Locking piece

22 Electrical contact
23 Electrical contact
24 Heat conductor
24*a* Heat dissipation surface
25 Heat conductor
26 Film
27 Lamp
28 Lampholder
29 Bulb
30 Housing
31 Base
32 Base web
33 Underside of base
34 Bayonet-type closure element
35 Bow contact
36 Electrical contact
A Longitudinal axis
h1 Height of engagement region of base

The invention claimed is:

1. A lamp; comprising:
at least one housing;
a heat source connected thereto; and
a base for connection to a lampholder of a luminaire,
wherein the base has at least one electrically non-conducting heat dissipation surface for contacting the lampholder of the luminaire, and
wherein at least one said heat source is thermally conductively connected to the at least one electrically non-conducting heat dissipation surface.

2. The lamp as claimed in claim 1,
wherein the heat source comprises a light source and a driver circuit.

3. The lamp as claimed in claim 1,
wherein the base is a bayonet-type base, in which a bayonet-type closure element protrudes at one end and on which electrical contacts are formed laterally.

4. The lamp as claimed in claim 3,
wherein the electrical contacts are bow contacts, which are located on webs extending laterally from the base.

5. The lamp as claimed in claim 4,
wherein the contacts are arranged on the underside of the webs, said underside facing towards the lampholder.

6. The lamp as claimed in claim 1,
wherein the base is a bayonet-type base, in which a bayonet-type closure element protrudes at one end, and wherein electrical contacts are formed on a housing underside, which surrounds the bayonet-type closure element.

7. The lamp as claimed in claim 3,
wherein the electrical contacts are arranged radially symmetrically about the bayonet-type closure element.

8. The lamp as claimed in claim 1,
wherein the base comprises at least one locking piece for a ball lock.

9. The lamp as claimed in claim 8,
wherein the base has at least one laterally arranged electrical contact.

10. The lamp as claimed in claim 9,
wherein the base has at least one electrical contact arranged at the end.

11. The lamp as claimed in claim 10,
wherein the at least one electrical contact which is arranged on the underside represents a heat dissipation surface.

12. The lamp as claimed in claim 1,
wherein the base is a base in accordance with the Gardena principle.

13. The lamp as claimed in claim 1,
wherein the height at least of that part of the base which is in engagement with a lampholder is no more than 15 mm.

14. The lamp as claimed in claim 1,
wherein at least one heat dissipation surface is covered at least partially by a thermally conductive film.

15. The lamp as claimed in claim 1, further comprising:
a cylindrical extension on the base, in which extension at least one of an electronic; electrical circuit; and a part thereof, is accommodated.

16. A luminaire comprising a lampholder for accommodating a lamp, the lamp comprising:
at least one housing;
a heat source connected thereto; and
a base for connection to a lampholder of a luminaire,
wherein the base has at least one electrically non-conducting heat dissipation surface for contacting the lampholder of the luminaire, and
wherein at least one said heat source is thermally conductively connected to the at least one electrically non-conducting heat dissipation surface and with the at least one electrically non-conducting heat dissipation surfaces being in thermal contact with at least one of the at least one electrically non-conducting heat dissipation surfaces of the lamp when the lamp is inserted;
wherein the heat dissipation surfaces thereof are thermally conductively connected to a cooling element.

17. A system, comprising:
a lamp, comprising:
at least one housing;
a heat source connected thereto; and
a base for connection to a lampholder of a luminaire,
wherein the base has at least one electrically non-conducting heat dissipation surface for contacting the lampholder of the luminaire, and
wherein at least one said heat source is thermally conductively connected
to the at least one electrically non-conducting heat dissipation surface; and
a luminaire, comprising a lampholder for accommodating the lamp.

18. The system as claimed in claim 17,
wherein a thermal bonding means is provided between the base of the lamp and the lampholder of the luminaire;
wherein the thermal bonding means comprises at least one of a thermally conductive paste and a thermally conductive film.

19. The system as claimed in claim 17,
wherein the base of the lamp and the lampholder of the luminaire have a deviation in form, at least in sections.

* * * * *